US009266703B2

(12) United States Patent
Farrell, III

(10) Patent No.: US 9,266,703 B2
(45) Date of Patent: Feb. 23, 2016

(54) CHAIN STOPPER FOR CHAIN PULLER

(75) Inventor: Joseph E. Farrell, III, Fort Lauderdale, FL (US)

(73) Assignee: RESOLVE MARINE GROUP, INC., Fort Lauderdale, FL (US)

( * ) Notice: Subject to any disclaimer, the term of this patent is extended or adjusted under 35 U.S.C. 154(b) by 444 days.

(21) Appl. No.: 13/210,792

(22) Filed: Aug. 16, 2011

(65) Prior Publication Data

US 2013/0043447 A1 Feb. 21, 2013

(51) Int. Cl.

| | |
|---|---|
| ***B66D 3/00*** | (2006.01) |
| *B63B 21/18* | (2006.01) |
| *B63C 7/02* | (2006.01) |

(52) U.S. Cl.

CPC ..... *B66D 3/006* (2013.01); *B63B 21/18* (2013.01); *B63C 7/02* (2013.01)

(58) Field of Classification Search

USPC ..... 254/253, 254, 255, 256, 257, 258, 259; 114/210, 293

See application file for complete search history.

(56) References Cited

U.S. PATENT DOCUMENTS

| | | | | |
|---|---|---|---|---|
| 3,289,626 | A * | 12/1966 | Petrie et al. | 114/200 |
| 3,499,629 | A * | 3/1970 | Horton | 254/93 R |
| 3,845,935 | A * | 11/1974 | Chambers | 254/110 |
| 5,934,216 | A * | 8/1999 | Childers et al. | 114/230.1 |
| 6,655,661 | B2 | 12/2003 | Hovik et al. | |
| 7,540,254 | B2 * | 6/2009 | Hystad | 114/199 |

* cited by examiner

*Primary Examiner* — Emmanuel M Marcelo
*Assistant Examiner* — Justin Stefanon
(74) *Attorney, Agent, or Firm* — Malin Haley DiMaggio & Bowen, P.A.

(57) ABSTRACT

A chain puller for use in marine salvage that includes a chain pulling platform having linearly disposed first and second chain stoppers. Each chain stopper includes a pair of pivotal doors that permit the passage of a chain in one direction while stopping the action of a chain moving in the opposite direction. The action on the pivotal doors uses gravity for vertical alignment. The pivotal doors are spaced apart the distance of a vertical chain-link in the static position and are pivotally spread apart to permit movement of the chain in one direction in the dynamic position.

1 Claim, 6 Drawing Sheets

CHAIN STOPPER FOR CHAIN PULLER

BACKGROUND OF THE INVENTION

1. Field of the Invention

This invention relates to a chain puller that is useful in salvage operations for hoisting or parbuckling marine objects such as ships or equipment, and specifically to an improved chain puller that includes a pair of chain stops that include gravity actuated chain securing doors.

2. Description of the Prior Art

The use of chain pullers, especially in salvage operations, is well known in the prior art. Typically, a chain puller is used to assist in hoisting and parbuckling operations in a marine environment for hauling up sunken ships and other submerged marine equipment. A chain puller is used with extremely strong chains with large links that may include a three inch diameter (the length of the chain link is approximately eighteen inches) and operate with maximum pulling forces that can be measured in hundreds of tons.

The pulling force is provided by hydraulically controlled moveable pistons driven by hydraulic fluid. Diesel engines connected to pumps are used for pumping the hydraulic fluid to the cylinders. The hydraulic pistons are connected at one end to movable rods that are in turn connected to pad eyes attached to a moveable chain stopper. During pulling, the chain is firmly engaged to the chain stopper that can only move a short distance (the length of the hydraulic cylinder piston rod) during each pulling sequence. The chain must be held in a static position by a second chain stopper when the hydraulic piston rod is returned to the start pull position.

One of the critical limitations of a chain puller is the ability to provide a large pulling force on the chain while at the same time being able to secure the chain in a fixed position when the hydraulic pistons and rods are being moved into place for the next pulling sequence. It is critical that the chain move in only one direction which is in the direction of the pulling force. It is important that the pulling chain be able to be stopped completely by the chain puller in a static position during periods of the operation in order to reposition the hydraulic actuators that move the chain.

The chain puller described herein includes two linearly aligned chain stoppers, each having a pair of doors that engage and release the chain that are not complex in operation, are activated by gravity and are extremely strong in fixing a chain so that the chain is movable only in one direction in use with the chain puller.

SUMMARY OF THE INVENTION

A chain puller for marine salvage operations for providing a large pulling force on a chain comprising a large rectangular flat supporting base plate, a chain having links of approximately three inches in diameter for pulling a load, a front chain stopper, having chain engaging doors allowing chain directional movement in one direction, firmly anchored to said supporting base plate, a back chain stopper having chain engaging doors that are gravity actuated and permit chain movement in one direction only, mounted on a slidable rigid plate and also slidably connected to the main supporting base plate and an hydraulically powered cylinder and moveable piston connected to said supporting base plate and said back chain stopper sliding plate for moving said back chain stopper in two directions.

The chain puller includes front and back chain stoppers that are longitudinally aligned from front to back so that the front and back chain stoppers receive the pulling chain that is used for pulling the workload. Each of the chain stoppers front and back are constructed similarly and include a pair of pivoting chain locking doors that together engage the chain and that move rotationally and that pivot downwardly through the action of gravity and a counter weight configuration. The back chain stopper is connected to the hydraulic actuator that provides force to pull and move the chain.

Each chain stopper front and back includes a pair of vertically-mounted door support plates rigidly welded to and extending from the base support plate, each door support plate being at an acute angle to each other. A cylindrical rigid bar called the chain guide is horizontally disposed between the front edges of the door support plates on the narrower opening. Each chain stopper also includes a rigid top plate firmly affixed to the top edges of the door support plates on each side. Each chain stop also includes left and right or port and starboard gussets firmly attached to the outside narrower opening. The front narrow opening of the change stopper also includes a pair of rigid rectangular blocks which are front chain guides.

The back chain stopper is mounted on a movable platform that provides the pulling force on the chain for moving the chain using hydraulic cylinders and pistons. Therefore, the back chain stopper includes additional pad eyes that are used for connecting the ends of the hydraulic cylinder rods that apply a pulling force to the sliding chain stopper platform.

The front chain stopper is firmly affixed to the supporting base plate in a rigid manner so that the hydraulic cylinders which are mounted to pad eyes adjacent the front chain stop are firmly in place and cannot be moved.

The front and rear chain stopper door support plates are used to support a pair of pivotally interacting doors which cooperate together to allow large chain links to move in one direction through the chain stopper and in the opposite direction to prohibit movement of the chain through the chain stopper. The front and rear chain stopper pivotal doors are angled relative to each other and spaced apart in the down position, the distance equivalent to the thickness of one link of vertical chain.

To operate the chain puller, the operator connects one end of the chain to a workload that is to be pulled. This could be a salvage operation in which a sunken ship is to be pulled. The chain puller mounted to a platform that is anchored to the ground or to a barge or other vessel so that the chain puller cannot move. The chain that is affixed at one end to the workload is then fed through the chain puller including the front chain stopper and the rear chain stopper. An area beyond the rear of the chain puller is used as a chain reservoir to receive excess chain as the chain is being pulled through the chain puller.

Hydraulic actuators provide the force necessary to move the chain in one direction by pulling on the chain and the workload. The front chain stopper and the rear chain stopper act to position and hold the chain relative to the chain puller during the sequential operation in which the rear chain stopper applies the pulling force from the hydraulic actuators onto the chain in a rearward direction causing movement of the chain which can move one way through the front chain stopper at the same time. When the hydraulic piston rod reaches maximum or full extension, the chain pulling stops and the piston rod must be repositioned. Once the pulling action of the hydraulic actuators cease during the sequence, the front chain stopper doors engage the chain links to prevent the chain from moving in a forward direction towards the workload while the hydraulic actuator and the rear chain stopper can freely travel backwards or towards the front chain stopper to reposition the rear chain stopper relative to chain for the next pulling action on the chain. Thus, the chain can pass through the front and rear chain stoppers in one direction while being prevented from moving in the opposite direction by the locking action of the chain engaging doors which are mounted pivotally on the backside or rear side of both the front chain stopper and the rear chain stopper.

The chain engaging pivotal doors are discussed in greater detail. The front chain stopper and the rear chain stopper each have a pair of pivotal doors on the rear side of the angled door support plates. The pair of doors work together by rotational movement. The doors may be L-shaped or other shape for counterbalancing so that the doors return to a static, vertical, non-pivoted position because of gravity when a vertical chain link is placed between the pivotal doors. The spacing between the doors is sized to be approximately the thickness of a vertical chain link. Because of the angle provided by the door support plates (which is an acute angle) and the angle between the pivotal doors laterally and the location of the pivotal joint of each door, a horizontal chain link can not open or spread apart the doors in one direction when a vertical chain link is positioned between the doors in the down static position. However, in the same door position, movement of the rear chain stopper forward relative to the chain and a horizontal chain link will cause the pivotal doors to pivot outwardly and upwardly for one chain link until it encounters a vertical link which will allow the doors to pivot by gravity to a static position. Moving the rear chain stopper in a forward direction is the same relative movement with respect to the chain as moving the chain in a rearward direction through the front chain stopper. The movement of the pivotal doors on each chain stopper is thus the key element in providing directional movement of the chain in only one direction through a chain stopper.

It is an object of this invention to provide an improved chain stopper for use with a chain puller for marine salvage operations that is non-complex in structure and employs a pair of pivotal doors to control the movement of a chain in one direction in a chain stopper.

It is another object of this invention to provide an improved chain puller of increased efficiency and non-complexity in design while operating using gravity to secure the chain.

These and other objects will become evident to those of ordinary skill in the art with respect to the invention disclosed herein.

PREFERRED EMBODIMENT OF THE INVENTION

Figure 1A:
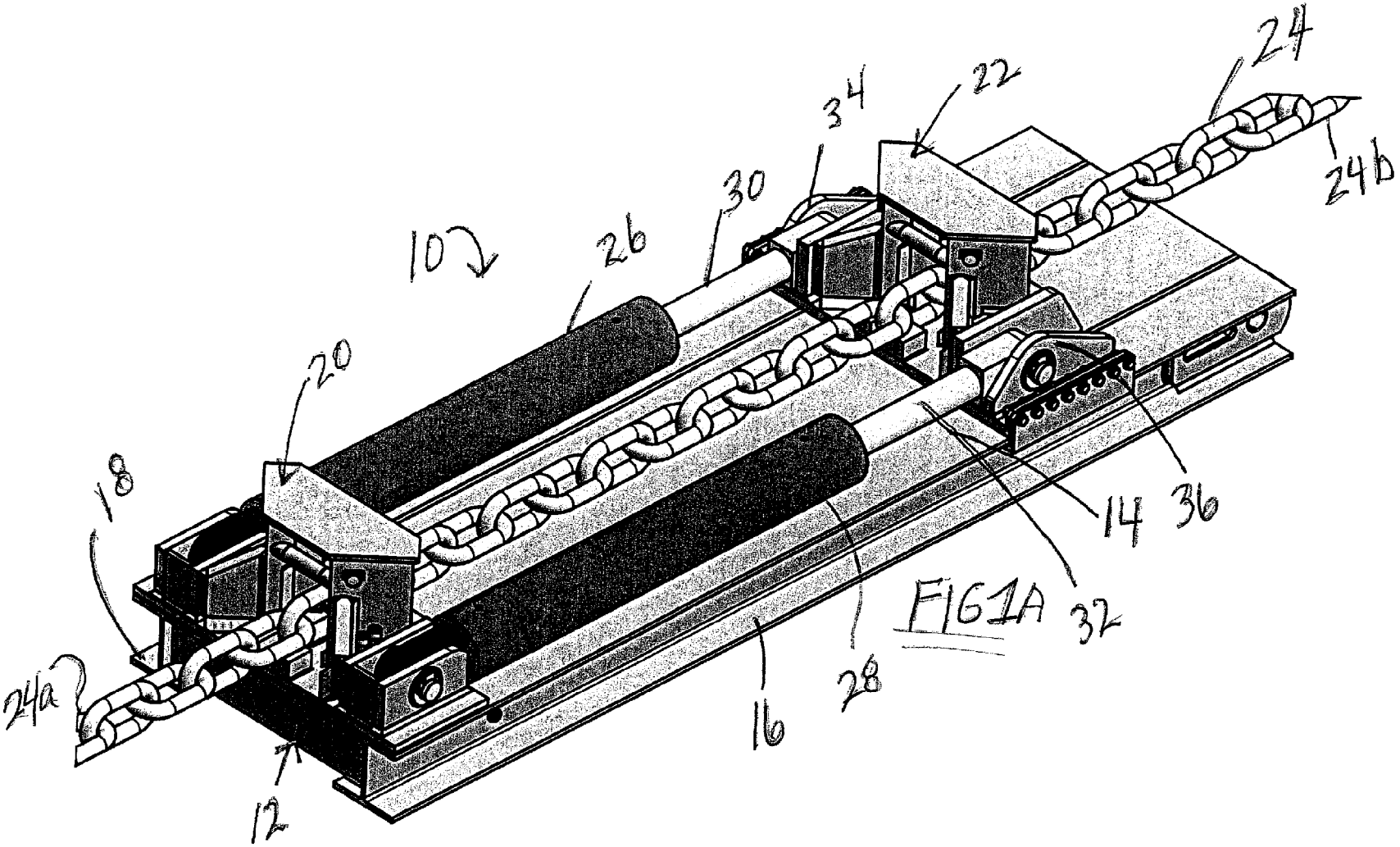
FIG. 1A shows a perspective view of a chain puller with the hydraulic actuator piston rods extended in accordance with the present invention.
Figure 1B:
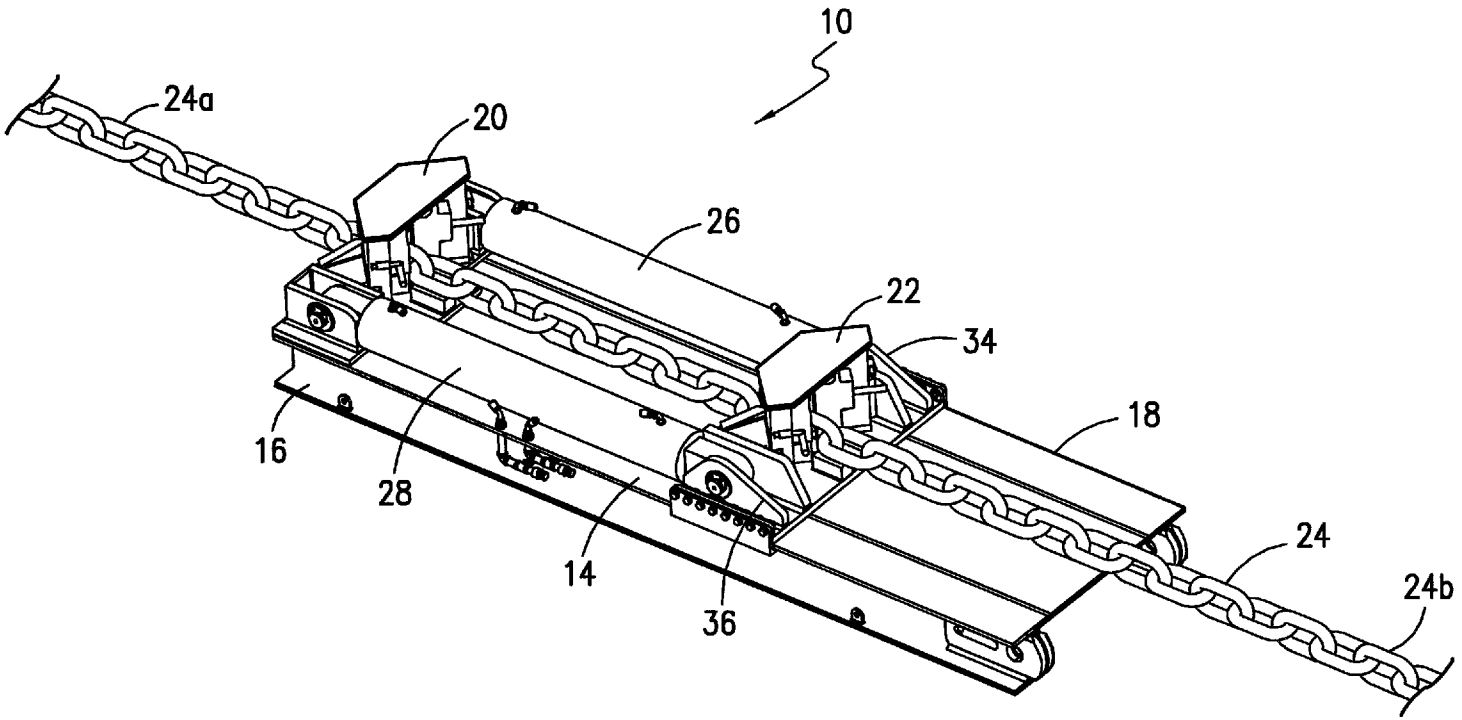
FIG. 1B shows a perspective view of a chain puller with the hydraulic actuator piston rods retracted into the cylinders.

Referring now to the drawings and in particular FIG. 1A and FIG. 1B, a chain puller 10 employing the present invention is shown. The chain puller 10 includes a rigid base plate 12 connected underneath to a pair of support beams 16 and 18 which are connected on the base of the chain puller 10. A chain puller can weigh 9 tons, be approximately 19 feet in length, and can have a hydraulic system that operates at 5000 PSI. Typically a chain puller can be rated to pull 300 tons. Chain puller 10 includes a pair of hydraulic actuators having cylinders 26 and 28 and internal pistons (not shown) that include piston rods 30 and 32 which are pivotally connected at one end to a movable chain stopper 22 and pad eyes 34 and 36. The front chain stopper 20 is rigidly welded and fixed to the base plate 12 of chain puller 10 and the supporting structure beams 16 and 18. The rear chain stopper 22 is movable by the action of the hydraulic pistons in cylinders 26 and 28. Chain 24 is connected through the front chain stopper 20 and rear chain stopper 22. In this example in FIG. 1A and FIG. 1B, the chain 24 which includes end 24*a* which would be connected to an object to be pulled and chain end 24*b* which would be portion of the chain not under tension going to a chain storage area. The chain puller 10 is attached to a platform anchored to the ground or a vessel such as a barge not shown so that the chain puller 10 cannot move.

Chain stopper 20 includes a pair of pivoting movable doors described below that allow the chain 24 to proceed in one direction when the chain is pulled through the chain stopper 20 while preventing the chain from moving through the chain stopper 20 because of the action of the pivotal doors which are described below. Rear chain stopper 22 also includes a pair of similar doors which act to permit the chain stopper housing 22 to be pulled to the left by the action of the hydraulic pistons and cylinders 26 and 28 allowing the chain 24 to pass through the pivoting doors as the chain stopper 22 moves to the left in FIG. 1A. During the dynamic process of pulling on the chain 24, the chain stopper 22 will have its pair of doors in a locked position, blocking the chain 24 firmly so that the chain puller and hydraulic mechanism move the chain stopper 22 and the chain 24 to the right towards chain end 24*b* pulling on the chain 24 with full force. Chain 24 is also permitted to pass through front chain stopper 20 while the chain 24 is being pulled.

Figure 2:
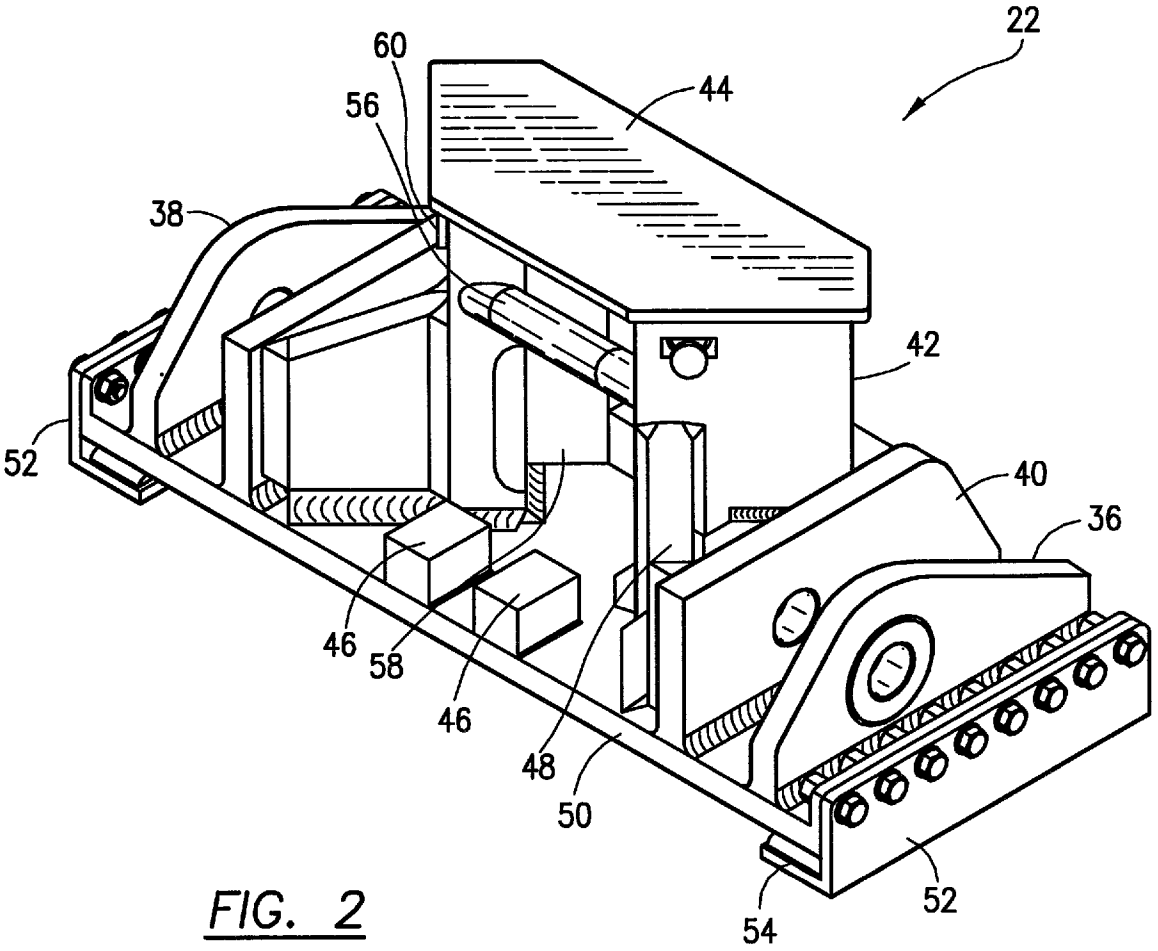
FIG. 2 shows a perspective view of the rear chain stopper used in the invention.

Referring now to FIG. 2, the assembly for rear movable chain stopper 22 is shown. Base plate 50 is attached to a pair of side block guides 52 which allow the chain stopper assembly 22 to be moved horizontally through the action of the hydraulic actuators having cylinders and pistons which are not shown in FIG. 2. The hydraulic actuators are connected to the chain stopper 22 using pad eyes 36 and 40 which connect to a piston rod not shown for moving the chain stopper relative to chain 24 and also for pulling chain 24. The chain stopper 22 assembly also includes a top rigid plate 44 connected to a pair of vertical door support plates 42 which are angled inwardly on each side. The door support plates 42 are further strengthened by a pair of gussets 48 which are rigidly attach to each of the door support plates 42 perpendicularly. The door support plates 42 and gussets 48 and the pad eyes 36 and 40 are firmly attached to the base plate 50 by welding. The chain stopper 22 assembly also includes a chain guard 56 which is a rigid cylindrical bar that is attached on each side and to the door support plates 42, both left and right. The chain stopper 22 assembly also includes a pair of guides 46 that are arranged to guide the chain when chain 24 is positioned within the assembly. A pair of pivotal one-way chain engaging doors 58 are pivotally attached on the rear side of the chain stopper 22 assembly and are described in greater detail below.

The purpose of the assembly 22 is primarily to pull a chain 54 in one direction using the pivotal locking doors 58 and when the assembly 22 is moved in the opposite direction, to allow the chain 54 to pass through the pivotal doors 58 which are described below.

Figure 3:
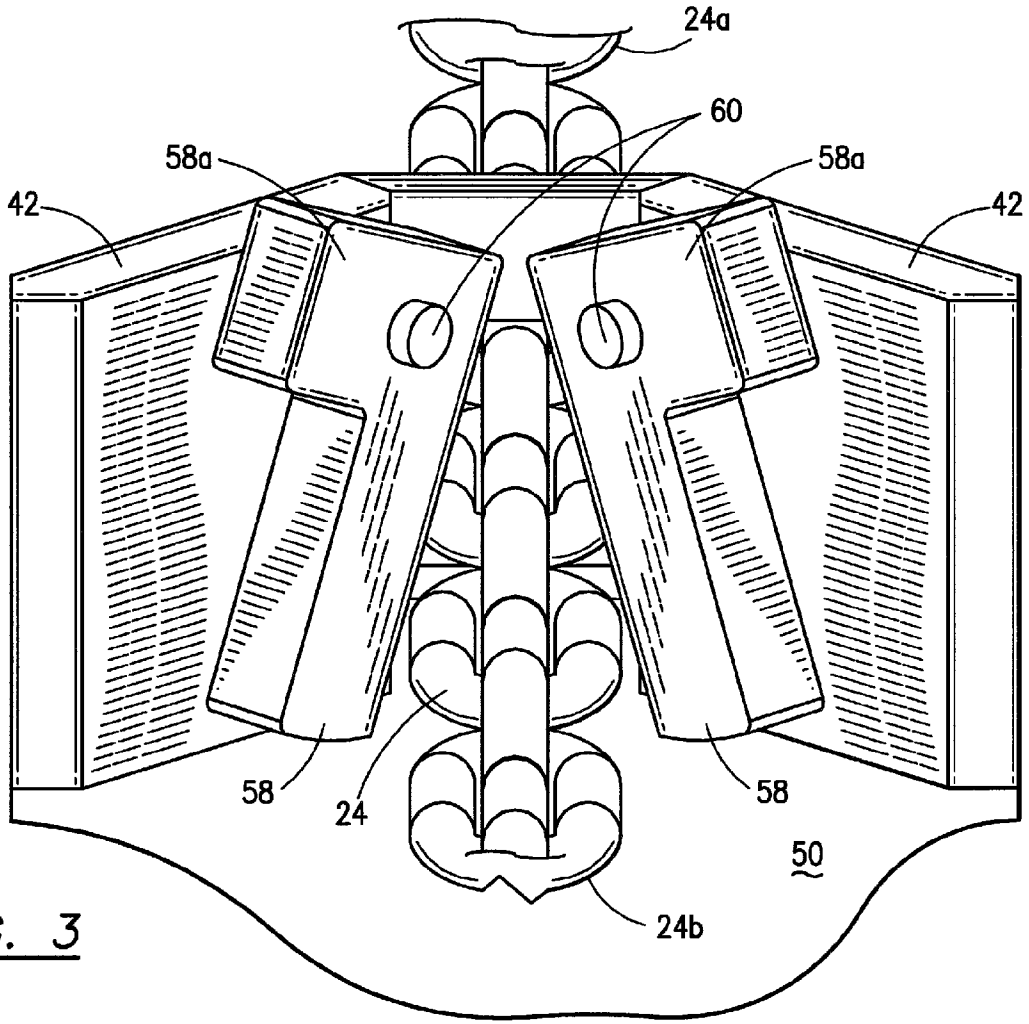
FIG. 3 shows a front elevational view in perspective of a chain stopper with a chain partially cutaway.

Referring now to FIG. 3, pivotal chain engaging doors 58 are shown attached by pins 60 to the door support plates 42 which have been discussed relative to FIG. 2. The vertical door support walls 42 are welded to the base plate 50. As shown in FIG. 3, the chain 24 and the end of chain 24*b* are shown disposed at an angle relative to vertical as the doors 58 are pushed outwardly by movement of the chain 24 through the chain stopper 22 in that each horizontal link of the chain 24 pushes the pivotal doors 58 outwardly near their bottom surfaces. The upper portion of each L-shaped door 58 includes a top counterweight portion 58*a* on each side to create a moment of force around pin 60 on the base of each pivotal door 58 which acts to force the bottom end face of the door 58 downwardly due to the force of gravity and the L-shape of the door as a counterweight portion 58*a*. The door 58 does not have to be L-shaped and will pivot downwardly around pin 60 by gravity, but the L-shape improves the downward action. The pin 60 should be in the upper one half of the length of door 58. In the disposition shown in FIG. 3, the chain stopping device is moving toward chain end 24*a* and away from chain end 24*b*. This would be the action required to return the chain puller mechanism to its initial position to engage the chain 24 in a pulling operation. The front chain stopper 20 shown in FIG. 1 would be holding the chain in a locked position while the rear chain stopper 22 moves back to the initial hydraulic actuator position. This relative movement towards chain end 24*a* forces the doors 58 to spread apart pivoting around the pins 60 in a pivotal motion allowing relative movement between chain 24 and the rear door chain stopping mechanism 22.

Figure 4:
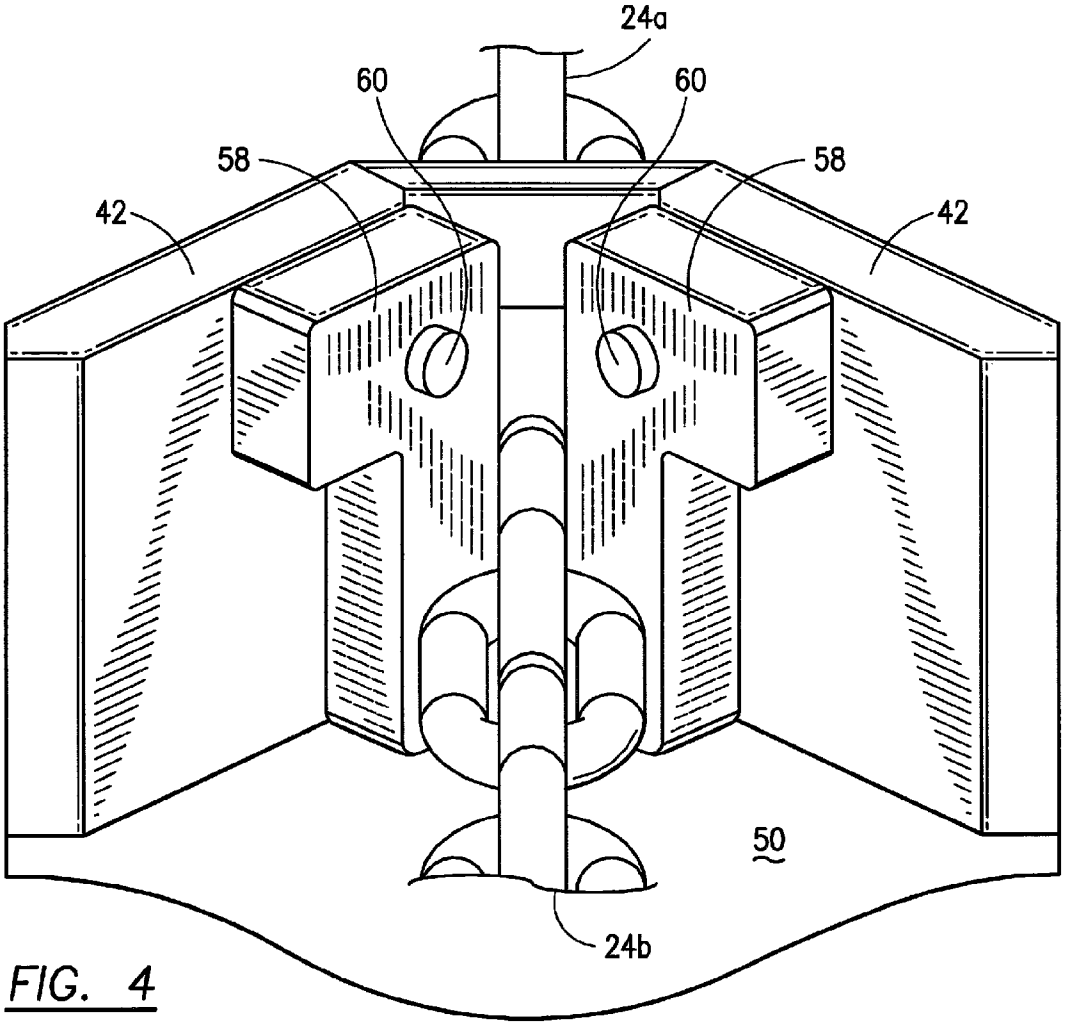
FIG. 4 shows a back perspective view of a chain stopper in accordance with the invention with the pivotal doors held upwardly by the action of a horizontal chain link.

Referring now to FIG. 4, the back side of chain stopper 22 is shown. There is no relative motion between the doors 58 and support plates 42 and chain 24. In this disposition, the doors 58 are vertical along their longest length perpendicular to base plate 50. Note that the separating space between each door 58 in the down position as shown is large enough to allow a single vertical chain link to be disposed in between. In this configuration, movement of the chain 24 toward chain end 24*b* would result on a pulling on the chain in the direction of chain end 24*b* which would be caused by action of the hydraulic cylinders and pistons. Note, with the pivotal doors 58 in the down vertical position as shown in FIG. 4, the chain link is firmly locked against the angled disposition of the doors 58. The chain 24 cannot move toward the chain end 24*a*. Pivotal doors 58 are firmly held vertically in place by the relative door position to each other and the vertical chain link.

Figure 5:
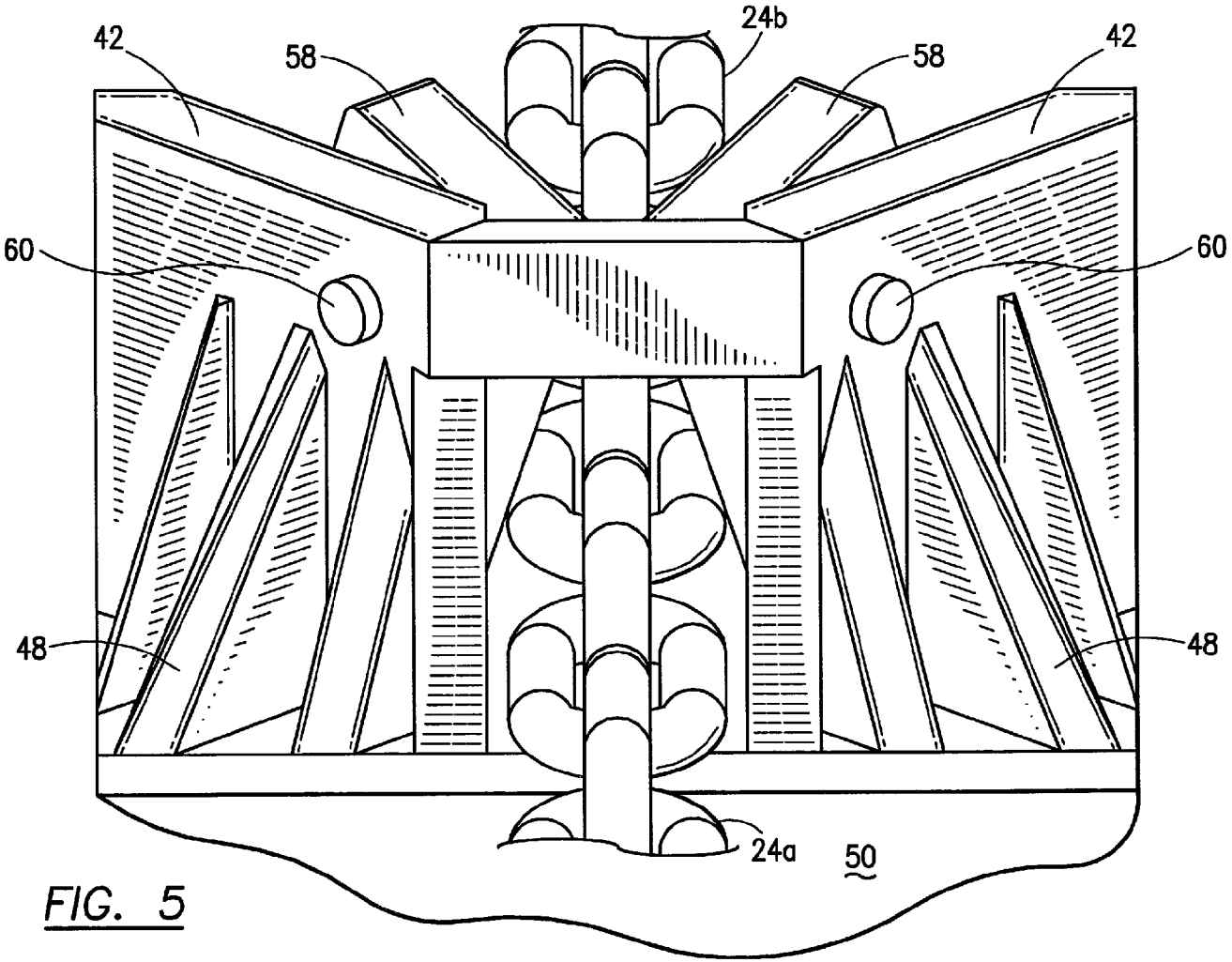
FIG. 5 shows the same view as in FIG. 3 except the pivotal doors are down and a vertical link of the chain is shown between the doors in the down position.

Referring now to FIG. 5, the front side of the chain stopper 22 assembly is shown. This example is shown from the other side of FIG. 3. Chain 24 and the chain puller are being moved relative to each other such that the doors 58 that pivot from pins 60 and the entire chain stopper mechanism is moving toward the observer causing doors 58 to spread apart, allowing the chain stopper to return (as shown in FIG. 1) to a position where the hydraulic cylinders and pistons can initiate pulling the chain 24.

When the chain is pulled in the direction of chain end 24*b* back through the doors, the structure allows the system to go from a static holder on the chain to a dynamic ratcheting action. The doors 58 catch every horizontal link as the chain is pulled through.

The chain stopper door 58 structure can be modified to fit any size chain and has the ability to pass bolt links through as well. The backing plate angle and gussets can be arranged as necessary to distribute the expected loads encountered by the stopper. The doors 58 are mounted using pins such that the doors can easily be replaced if excessive wear occurs over time. The doors 58 have been shown to pivot to the down position by gravity as shown in FIG. 4. In addition to gravity or instead of gravity, a spring could be added to each door 58 that returns each door 58 to the down position. The spring could be in the pivot pin or connected to the door and the platform.

The chain stopper doors 58 shown with the chain puller in this invention have been described in accordance with the preferred embodiment. However, other important embodiments based on this invention through modification would be within the realm of one of ordinary skill in the art.

What I claim is:

1. A chain puller that includes at least one chain stopper and a chain used with the chain puller, said chain having vertically and horizontally disposed links when used with said chain puller, said links having thickness comprising:

rigid base plate that can be fastened in place;

chain that can be attached to an object to be pulled;

first chain stopper rigidly connected to said rigid base plate;

second chain stopper moveably connected to said rigid base plate and strategically placed relative to said first chain stopper in the same plane so that a chain can pass through said first chain stopper and said second chain stopper in a straight line;

said first chain stopper including a pair of rectangular door support plates, each door support plate having a top, a bottom, and parallel sides rigidly fixed together and rigidly fixed to said rigid base plate base and spaced apart at an angle to each other, and first and second "L"-shaped pivotal doors mounted on one vertical side of each of said door support plates, the "L"-shaped doors being spaced apart by the thickness of a vertical chain-link in the chain lock position;

said second chain stopper including a second pair of angled door support plates rigidly fixed at one end to said rigid base plate and spaced at least the width of the horizontal chain-link, and first and second "L"-shaped pivotal doors mounted on the back side of said angled support plates, said "L"-shaped pivotal doors being spaced apart by the thickness of a vertical chain-link; and said second chain stopper connected to a hydraulically actuated cylinder and piston for moving said second chain stopper in a first direction and reciprocally in a second direction based on the activation of said hydraulically actuated cylinder and piston.

* * * * *